US010098442B2

(12) United States Patent
Bergkvist

(10) Patent No.: US 10,098,442 B2
(45) Date of Patent: Oct. 16, 2018

(54) CARRYING SYSTEM

(71) Applicant: Coxa Carry AB, Ahus (SE)

(72) Inventor: Claes Bergkvist, Ahus (SE)

(73) Assignee: VIGMED AB (SE)

( * ) Notice: Subject to any disclaimer, the term of this patent is extended or adjusted under 35 U.S.C. 154(b) by 0 days.

(21) Appl. No.: 14/413,956

(22) PCT Filed: Jul. 11, 2013

(86) PCT No.: PCT/EP2013/064732
§ 371 (c)(1),
(2) Date: Jan. 9, 2015

(87) PCT Pub. No.: WO2014/009493
PCT Pub. Date: Jan. 16, 2014

(65) Prior Publication Data

US 2015/0208792 A1 Jul. 30, 2015

(30) Foreign Application Priority Data

Jul. 12, 2012 (SE) ..... 1250825

(51) Int. Cl.

| | |
|---|---|
| ***A45F 3/14*** | (2006.01) |
| ***A45F 3/04*** | (2006.01) |
| ***A45F 3/12*** | (2006.01) |
| *A45F 3/00* | (2006.01) |
| *A44B 11/26* | (2006.01) |
| *F41H 1/02* | (2006.01) |

(52) U.S. Cl.
CPC ..... *A45F 3/14* (2013.01); *A45F 3/04* (2013.01); *A45F 3/12* (2013.01); *A44B 11/26* (2013.01); *A45F 2003/001* (2013.01); *A45F 2003/142* (2013.01); *A45F 2003/144* (2013.01); *A45F 2003/146* (2013.01); *F41H 1/02* (2013.01)

(58) Field of Classification Search
CPC . A45F 2003/146; A45F 2003/148; A45F 3/14
See application file for complete search history.

(56) References Cited

U.S. PATENT DOCUMENTS

| | | | | |
|---|---|---|---|---|
| 5,427,290 A * | 6/1995 | Thatcher | A45F 3/04 | 224/148.2 |
| 5,950,894 A * | 9/1999 | Haber | A45F 3/04 | 224/153 |
| 6,049,954 A * | 4/2000 | Britto | A44B 11/2511 | 24/579.11 |

(Continued)

FOREIGN PATENT DOCUMENTS

| | | |
|---|---|---|
| CN | 2034404 U | 3/1989 |
| CN | 1541587 A | 11/2004 |

(Continued)

*Primary Examiner* — Derek Battisti
(74) *Attorney, Agent, or Firm* — Fishman Stewart PLLC

(57) ABSTRACT

A carrying system comprising four carrying straps wherein a first and a third carrying strap are provided with a connecting body which is fixed at an end of each of the two carrying straps, and each and one of the remaining second and fourth carrying straps are provided with each a fastening body which is fixed at the corresponding end of the carrying strap, wherein said at least one connecting body is adapted to connect said respective fastening bodies.

20 Claims, 8 Drawing Sheets

(56) References Cited

U.S. PATENT DOCUMENTS

| | | | | |
|---|---|---|---|---|
| 6,283,350 | B1 * | 9/2001 | Gottmeier | A45F 3/04 224/627 |
| 6,687,963 | B1 * | 2/2004 | Chang | A44B 11/2584 24/265 BC |
| 7,070,077 | B2 * | 7/2006 | Egart | A45F 3/02 224/608 |
| 2005/0263551 | A1 * | 12/2005 | Dent, III | A44B 11/08 224/259 |
| 2008/0006668 | A1 * | 1/2008 | Nowacki | A45F 3/02 224/625 |
| 2009/0283561 | A1 * | 11/2009 | Zamora | A45F 3/12 224/264 |
| 2012/0037675 | A1 * | 2/2012 | Shepherd | A45C 3/00 224/259 |
| 2013/0036535 | A1 * | 2/2013 | Bergkvist | A45F 3/04 2/455 |
| 2013/0119101 | A1 * | 5/2013 | Hachisuka | A01D 34/902 224/261 |
| 2013/0302023 | A1 * | 11/2013 | Chamberlayne | F16M 11/041 396/423 |
| 2013/0341369 | A1 * | 12/2013 | Kacmarcik | A45F 3/14 224/259 |

FOREIGN PATENT DOCUMENTS

| | | | |
|---|---|---|---|
| CN | 201370238 | Y | 12/2009 |
| EP | 0447098 | A1 | 9/1991 |
| FR | 2630897 | A1 | 11/1989 |
| SE | 1050026 | A1 | 7/2011 |
| WO | WO-2006002696 | A1 | 1/2006 |
| WO | WO-2011087436 | A1 | 7/2011 |
| WO | WO-2014009493 | A1 | 1/2014 |

* cited by examiner

CARRYING SYSTEM

CROSS-REFERENCE TO RELATED APPLICATIONS

This application is a U.S. National phase based on PCT/EP2013/064732, filed on Jul. 11, 2013 entitled "CARRYING SYSTEM" which is based on Swedish Patent Application No. 1250825-5, filed on Jul. 12, 2012, which is hereby incorporated by reference in its entirely.

TECHNICAL FIELD

This application relates to a carrying system for improved handling, and in particular to a carrying system, a connecting body, a backpack, protective equipment, an article of clothing.

BACKGROUND

The international patent application published as WO2011087436 discloses a carrying system comprising an ergonomic back plate which is substantially covering the entire back of a user, a first carrying strap adapted to extend from a first position of an upper section of said back plate over a first shoulder of a user substantially diagonally downwards towards solar plexus of said user, a second carrying strap adapted to extend from a second position of said upper section of said back plate over a second shoulder of said user substantially diagonally downwards towards solar plexus of said user, a third carrying strap adapted to extend from a first position of a lower section of said back plate under a first arm of said user substantially diagonally upwards towards solar plexus of said user, and a fourth carrying strap adapted to extend from a second position; of said lower section of said back plate under a second arm of said user substantially diagonally upwards towards solar plexus of said user. The carrying system is characterized in that at least one of said carrying straps are provided with a connecting body which is fixated at its end, and each and one of the remaining carrying straps are provided with a fastening body which is fixated at its end, wherein said at least one connecting body is adapted to connect said respective fastening body.

Such a carrying system provides a simple and easy-to-use lock-and-release system for the carrying system, but either requires many release operations to release all straps of the carrying system or releases all straps simultaneously thereby causing a user to potentially drop a load being carried with the carrying system. The carrying system of WO2011087436 also requires multiple fastening actions. The system is furthermore adapted for two-hand use to be operated safely and efficiently.

There is thus a need for a carrying system that can be operated quickly requiring few operations, but safely without risking dropping the load being carried with the carrying system.

It is an object of the teachings of this application to overcome the problems listed above by providing a carrying system adapted for quick, but safe operation, through a clever and insightful arrangement of a connecting body and carrying straps some of which have fastening bodies and some of which are (removable) fixed to the connecting body. This object is achieved by a technique defined in the appended independent claims; certain embodiments being set forth in the related dependent claims.

According to a first aspect of the teachings herein a carrying system is provided, said carrying system comprising a first carrying strap adapted to extend from a first position of an upper back section of said carrying system over a first shoulder of a user substantially diagonally downwards towards the stomach area or solar plexus of said user, a second carrying strap adapted to extend from a second position of said upper back section of said carrying system over a second shoulder of said user substantially diagonally downwards towards the stomach area or solar plexus of said user, a third carrying strap adapted to extend from a first position of a lower back section of said carrying system under a first arm of said user substantially diagonally upwards towards the stomach area or solar plexus of said user, and a fourth carrying strap adapted to extend from a second position of said lower back section of said carrying system under a second arm of said user substantially diagonally upwards towards the stomach area or solar plexus of said user. The second and fourth carrying straps are provided with a connecting body which is connected to an end of each of the two carrying straps, and each and one of the remaining first and third carrying straps are provided with each a fastening body which is connected to the corresponding end of said carrying strap, wherein said connecting body is adapted to connect said respective fastening bodies.

Such a carrying system enables a quick, simple and safe removal from a carrier as it provides an easy release mechanism which quickly disengages two straps while two straps are fixed to the connecting body thereby effectively forming a safe carrying strap which the user can use to carry a load or to movably manipulate the carrying system. This is especially beneficial when the carrying system is arranged on a rucksack or backpack. The arrangement of the carrying straps and the connecting body enables such a rucksack or backpack to be carried over one shoulder or to remain hanging over one shoulder when the buckle is released. This allows a user to more freely release the connecting body from the fastening bodies.

In one embodiment each and one of said fastening bodies is adapted to be pressed into the connecting body and locked there, and wherein said connecting body comprises one or two adjacent to each other placed release buttons adapted to disengage the fastening bodies of the two carrying strap from the connecting body so that the carrying system may be disengaged from a carrying user. The use of release buttons provides an easy and quick manner of releasing the carrying straps to allow a user to quickly and easily disengage from the carrying system. In the case of two release buttons, the placement adjacent each other allows a user easy access to both release buttons for simultaneous manipulation thereby providing a release system which is very easy to use and operate.

In one embodiment each and one of said fastening bodies is adapted to be pressed into the connecting body and locked there, and wherein each fastening body is arranged with a release portion adapted to disengage the fastening body from the connecting body so that the carrying system may be disengaged from a carrying user and wherein said release portions are arranged to be placed adjacent each other when locked in the connecting body to enable easy access to said release portions. The use of release portions integrated into the fastening bodies provides a lock-and-release system that is robust while being simple and cheap to manufacture as it contains few moving parts. Such release portions also provide an easy and quick manner of releasing the carrying straps to allow a user to quickly and easily disengage from the carrying system. As the two release portions are arranged to be placed adjacent each other when locked they provide a user with an easy access to both release portions for simultaneous manipulation thereby providing a lock-and-release system which is very easy to use and operate.

In one embodiment the release portions are arranged in a recess of said connecting body and wherein said recess is arranged between said two respective fastening bodies when said fastening bodies are pressed into the connecting body to enable easy one-handed disengagement of the carrying system from said carrying user. By arranging the release portions in a recess a user is both intuitively and physically guided to the release portions for disengaging the carrying system in a simple manner. The guiding provided by the recess also facilitates one-hand operation of the release portions which further simplifies the operation of the lock-and-release system of the carrying system. The placement of the recess between the second and fourth carrying strap allows a user to secure the effective carrying strap being formed by the first and third carrying straps in cooperation with the connecting body with a part of one hand (for example a thumb), while operating the release portions with one or two fingers (for example long and index or index and ring fingers) of the same hand thereby enabling easy one-hand handling and operation of the carrying system.

In one embodiment the connecting body has a substantially round or circular periphery in a plane defined by (a longest extent of) said recess to enable easy one-handed disengagement of the carrying system from said carrying user by providing an ergonomic gripping position. The rounded shape of the connecting body is beneficial for one-handed use in that it provides an ergonomic grip for the palm or heel of a user's hand when operating the release portions with one or more fingers. The rounded shape also enables easier one-handed gripping as the rounded shape of the periphery causes the periphery to extend beyond the first and third carrying straps and their connection to the connecting body thereby forming a gripping surface suitable for gripping between (the base of) a user's thumb and the heel of the hand of the thumb.

In one embodiment the connecting body comprises at least one locking guard for protecting the release portions from accidentally being unlocked. This is a great advantageous since it otherwise may be easy to unlock the carrying system during certain movements.

In one embodiment the first, second, third and fourth carrying straps together form a cross when they are connected by means of said connecting body to enable a stable and ergonomic carrying position for the carrying system. This provides for a stable carrying of a load being carried with the carrying system as the cross shape effectively secures the load from moving in all directions, especially when utilized in combination with a backpack.

In one embodiment at least one of said third and fourth carrying straps is arranged with a tightening means for tightening the corresponding carrying strap. This allows the carrying system to be more rigidly secured to a carrying person for a more stable securing of the load.

In one embodiment the carrying system further comprises at least one strap cover which is arranged around the first and second carrying strap. These covers provide the carrying system with a softer contact with the shoulder and chest of the user.

In one embodiment the strap cover is detachable which allows the user to remove and change the cover depending on the application of the carrying system.

In one embodiment the strap covers is made of a washable material which allows the user to remove the cover and wash it so that it stays clean and fresh for a longer time and there by prolonging its service life.

According to a second aspect a backpack or rucksack is provided, the backpack comprising a carrying system according to above.

According to a third aspect an article of clothing or sports is provided, the article of clothing comprising an integrated carrying system according to above.

According to a fourth aspect protective equipment is provided, comprising a carrying system according to above, the protective equipment being protective equipment such as equipment for police and guard personnel.

According to a fifth aspect a connecting body is provided, the connecting body being adapted to be used in a carrying system according to above, said connecting body being adapted to be fixed at an end of two carrying straps, and said connecting body being adapted to connect respective fastening bodies of two carrying straps provided with each a fastening body.

The authors of the present application have realized that, after inventive and insightful reasoning, by arranging the carrying straps on one side of the carrying system to be fixed to the connecting body a full carrying strap is effectively formed for easy manipulation. The remaining carrying straps, which are provided with releasable fastening bodies, provide for a quick release that is simple to operate allowing a user carrying for example a backpack to quickly disengage one arm from the carrying system by pressing the release button(s) and thereafter easily and safely manoeuvre the backpack to disengage from the backpack and the carrying system. This is all achieved while providing an ergonomic and steadily secured carrying system.

The teachings herein find use in carrying systems such as backpacks and rucksacks, but also in protective equipment, life jackets, articles of clothing and tool belts or other carrying systems.

Other features and advantages of the disclosed embodiments will appear from the following detailed disclosure, from the attached dependent claims as well as from the drawings.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of the element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

Embodiments of the present disclosure will be described in the following references being made to the appended drawings, wherein.

DESCRIPTION OF EMBODIMENTS

The disclosed embodiments will now be described more fully hereinafter with reference to the accompanying drawings, in which certain embodiments of the disclosure are shown. This disclosure may, however, be embodied in many different forms and should not be construed as limited to the embodiments set forth herein; rather, these embodiments are provided by way of example so that this disclosure will be thorough and complete, and will fully convey the scope of the disclosure to those skilled in the art. Like numbers refer to like elements throughout.

Figure 1:
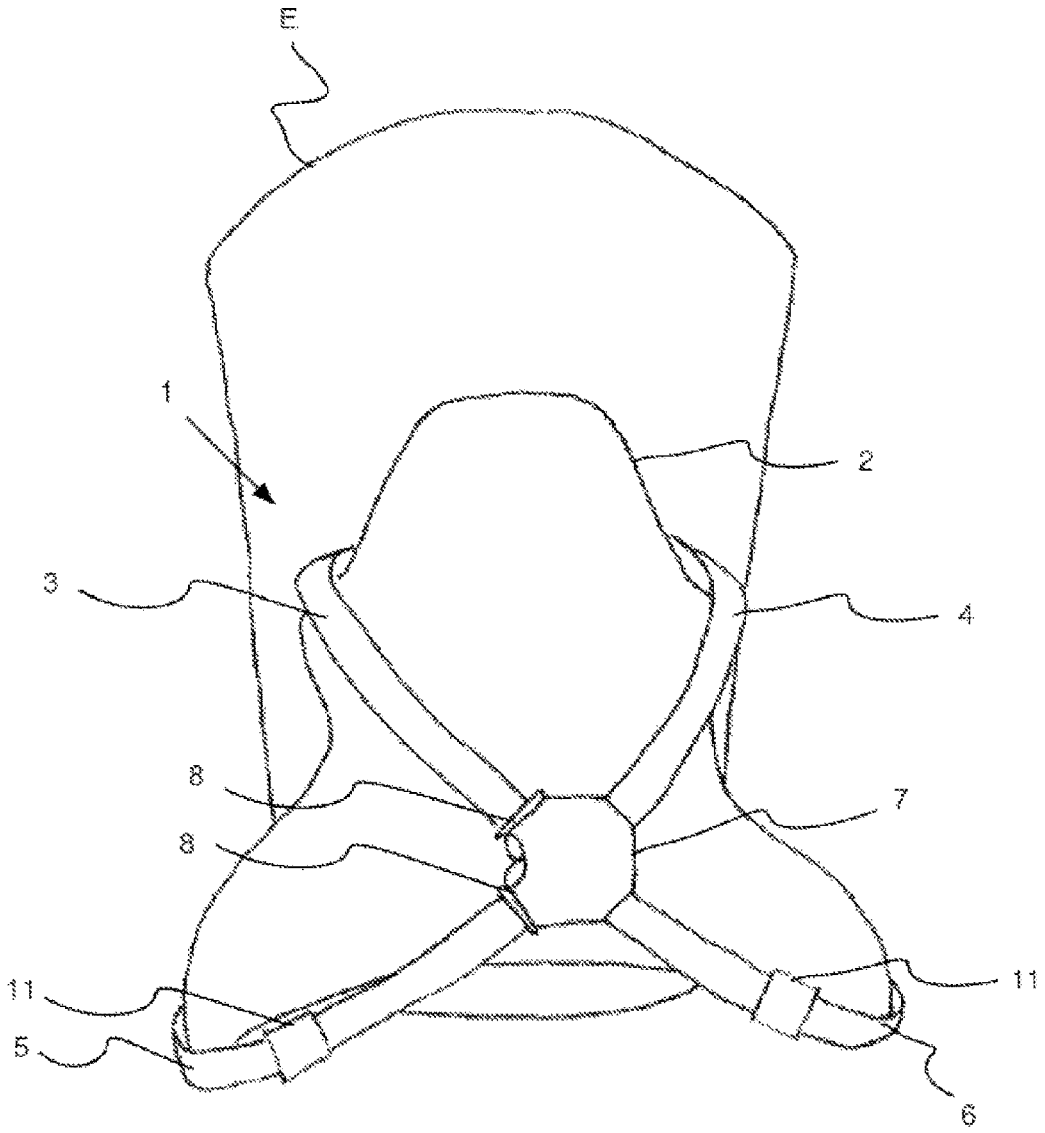
FIG. 1 shows a carrying system according to an embodiment of the present disclosure in a locked state.

FIG. 1 illustrates a carrying system according to a first embodiment of the present disclosure in a locked state and where the carrying system 1 is connected to an associated equipment E. The associated equipment E could e.g. be a backpack, protective equipment, life vest, climbing harness, sport equipment, professional gadgets or a tool belt. The carrying system 1, which is adapted to carry a load, comprises a load receptive unit 2, from hereon called a back plate, two upper carrying straps 3, 4, two lower carrying straps 5, 6 and a connecting body 7. The upper carrying straps 3, 4 are connected to the back plate at two positions located on the upper part or section of the back plate 2 and the lower carrying straps 5, 6 are connected to the back plate 2 at two positions located on the lower part or section of the back plate 2. From each connecting position each upper and lower carrying strap 3, 4, 5, 6 extends toward, e.g. the stomach of the user, where they are connected together by means of the connecting body 7 and a number of fastening bodies 8. The carrying straps 3, 4, 5, 6 may be a strap of varying size and thickness, e.g. a wider strap or a thinner rope, which may be adapted for every application in which the carrying system 1 is used in. In an alternative embodiment the second and the fourth strap may be fastened to the back side (not shown) of the connecting body.

In one embodiment the back plate 2 is an integral part of the associated equipment and the upper carrying straps 3, 4 are connected to an upper part or section of the associated equipment E and the lower carrying straps 5, 6 are connected to a lower part or section of the associated equipment E.

The connecting body 7 is fastened to one of the upper carrying straps 3, 4 and to one of the lower carrying straps 5, 6 which are located on the same side of the carrying system 1. On the same side in this context means on the right or left hand side of the carrying system 1 when it is being carried. The connecting body 7 includes, on the opposite side of where two of the carrying straps 3, 4, 5, 6 are fastened, two connectors each being able to receive a fastening body 8. The two carrying straps 3, 4, 5, 6 which are not directly fastened to the connecting body 7 have one fastening body 8 each, located at their free end. Preferably, the connecting body 7 is made in one piece.

Further, the carrying system includes two tightening means 11 which are located on the two lower carrying straps 5, 6. The carrying system 1 may, in another embodiment, include only one tightening means 11 on one of the carrying straps 5, 6 or in yet another embodiment is located on the upper carrying straps 3, 4. The tightening means 11 makes it possible for the user to adapt the length of the carrying straps 5, 6 and tightness of the carrying system 1 towards his/her body. This is an advantageous feature since the user may adjust the spread of the load to different areas of his/her body. In an alternative embodiment all four carrying straps 3, 4, 5, 6 may be tightened by tightening means (not shown) in the connecting body 7.

FIG. 1 shows the carrying system 1 in its locked state where the fastening bodies 8 are connected to the connecting body 7. In this example a first carrying strap 3 and a third carrying strap 5 are locked in the connecting body 7 through each a connecting body 8 and a second carrying strap 4 and a fourth carrying strap 6 are directly fastened to the connecting body 7.

Figure 2:
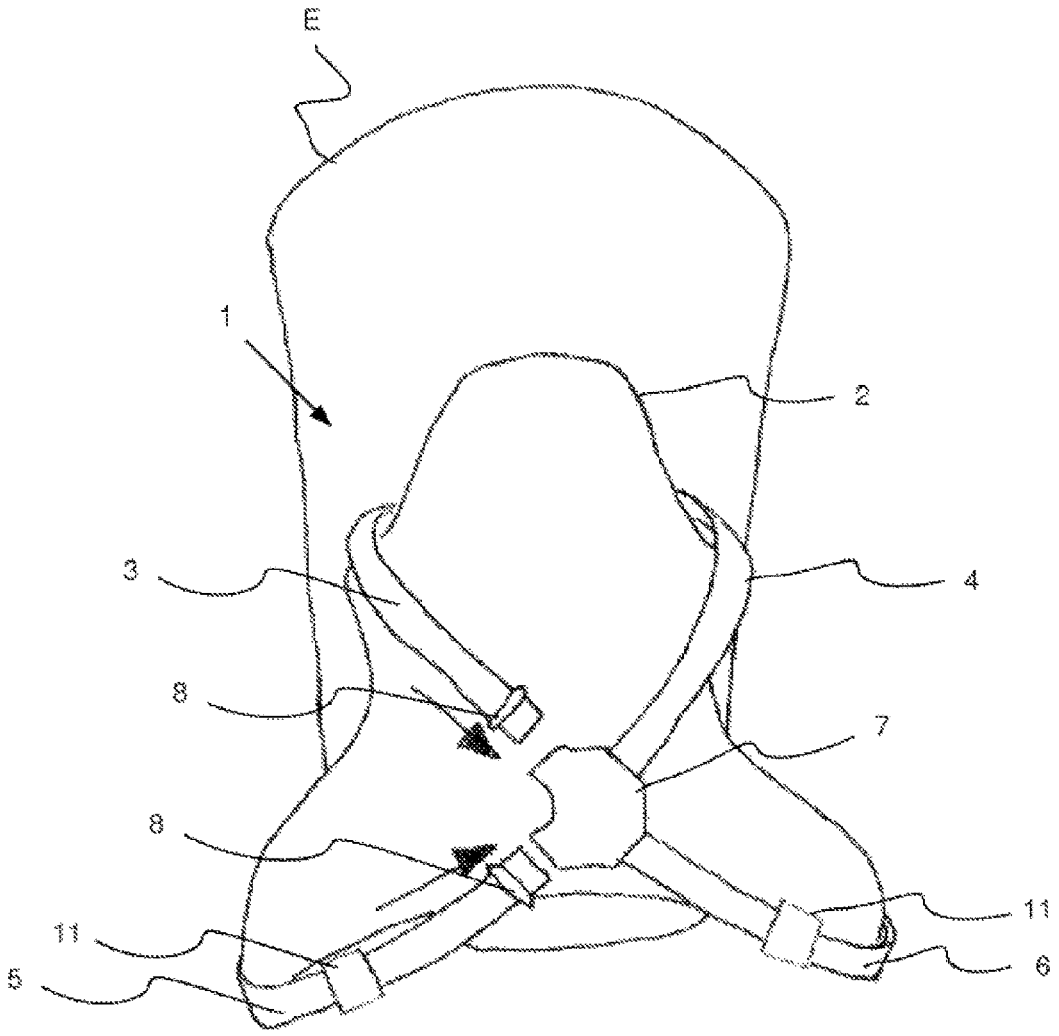
FIG. 2 shows the carrying system in FIG. 1 in an unlocked state.

FIG. 2 illustrates the carrying system in FIG. 1 but in an unlocked state where the fastening bodies 8 are about to be inserted into the connecting body 7. After the carrying plate 2 has been placed on the back of the user and the upper carrying straps 3 and 4 have been placed on the user's shoulders, the fastening bodies 8 are, each and one, inserted into the connecting body 7 and locked there. To release the fastening bodies 8 from the connecting body 7 the user must push on the side of the fastening bodies 8 so that they unlock themselves in the connecting body 7. This is further described in FIGS. 3 and 4.

The releasable fastening bodies 8 may be on the same side of the carrying system since the carrying system 1 and the associated equipment E then may not fall off the user when releasing the fastening bodies 8. The carrying system 1 and its associated equipment E may then still hang on one shoulder of the user so that the user may gently and easily put down the carrying system 1 by himself/herself.

Figure 3:
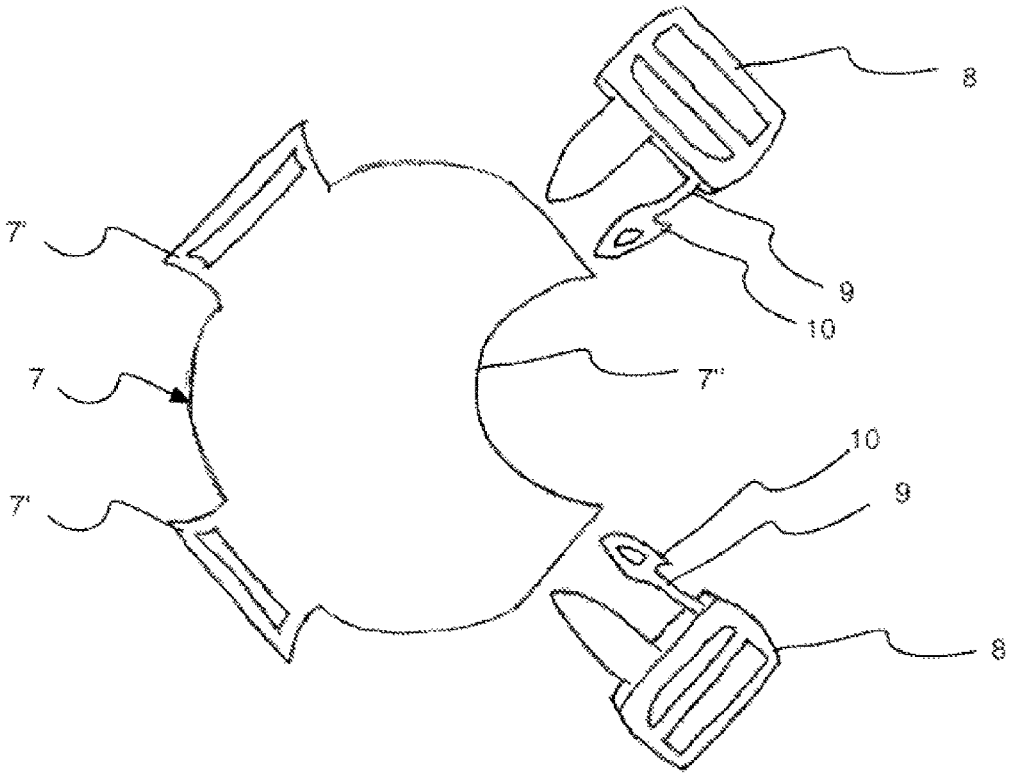
FIG. 3 shows a connecting body according to an embodiment of the present disclosure in an unlocked state.

FIG. 3 shows the connecting body 7 and the fastening bodies 8 used in the carrying system 1 shown in FIGS. 1 and 2 in its unlocked state. The connecting body 7 includes two fastening parts 7' for fastening two carrying straps 3, 4, 5, 6 located on the same side of the carrying system and two cavities (not shown) for receiving the two fastening bodies 8. On the same side of the connecting body 7 as the two cavities are located there is a recess 7" provided which partly extends into the cavities. The recess 7" is shaped to guide a user's fingers to the side of the fastening bodies 8 which partially extends out through the recess when the fastening bodies 8 are pressed into and locked in the connecting body 7.

On one side of each fastening body 8, preferably the side which extends throughout the recess 7", a release portion with a release button 9 and a tap 10 is provided. When the fastening body 8 is inserted into the connecting body 7 the release button 9 locks the fastening body 8 to the connecting body 7 by means of the tap 10. A simple, yet robust lock-and-release system is thus formed for easy handling when engaging and disengaging the carrying system 1.

Figure 4:
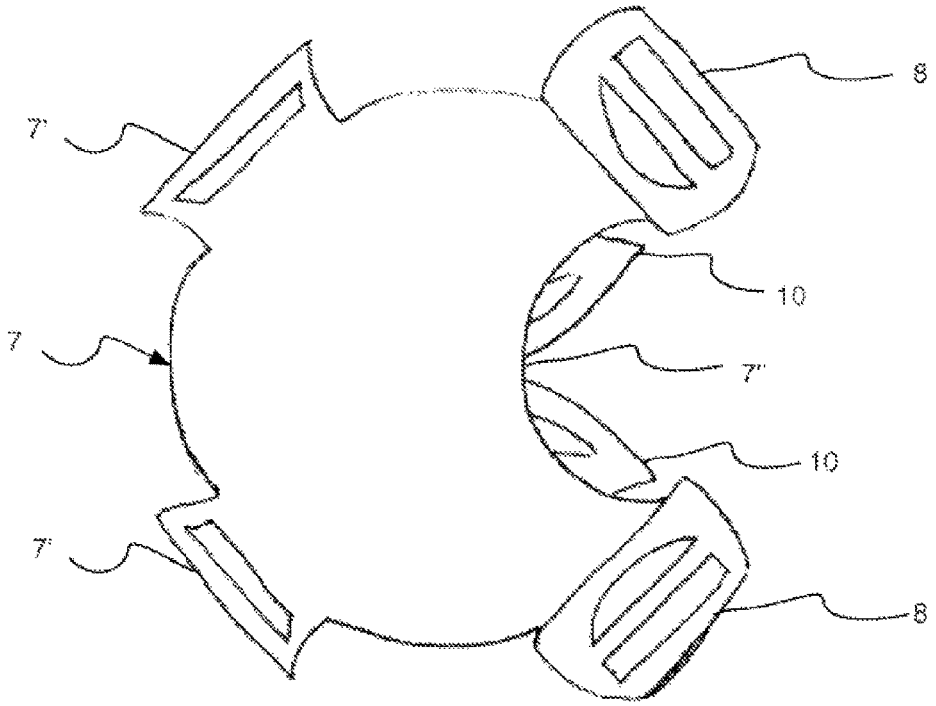
FIG. 4 shows the connecting body in FIG. 3 in a locked state.

FIG. 4 shows the connecting body 7 and the fastening bodies 8 in a locked state. The fastening bodies 8 are in this state prevented from moving out of the connecting body 7 since the tap 10 of the release button 9 is biased to engage the connecting body 7 (for example by hooking on to a flange or edge of the connecting body 7). To release the fastening body 8 from the connecting body 7 the user simply presses the release button 9 so that the tap 10 runs freely in the cavity without engaging the connecting body 7. The recess 7" makes it easy for the user to spot and reach the release buttons 9 so that the fastening devices 8 may easily and quickly be unlocked, which is beneficial for example for (mountain) climbers, military personnel and others. Another benefit of having the fastening bodies 8 on the same side and the recess 7" is that the user may easily unlock the carrying system 1 with only one hand.

As can be seen in FIG. 4, the release buttons 9 are arranged adjacent each other when the fastening bodies 8 are locked in the connecting body 7. This allows for a simple unlocking of the connecting body 7.

In one embodiment the periphery of the connecting body is substantially rounded (or circular) in a plane parallel to a plane defined by the recess 7". In FIGS. 3 and 4 the plane defined by the recess 7" is parallel to the plane of the figures. This rounded shape is beneficial in that it causes a part of the connecting body to protrude past the point where the carrying straps 3, 4, 5, 6 effectively join the connecting body through the fastening parts 7'. This protrusion effectively forms a gripping portion that can improve a user's grip of the connecting body 7 when operating it. The protrusion is also shaped so that it provides an ergonomic gripping portion as the rounded shape of the connecting body will cooperate with the rounded shape of the heel of a gripping hand. This facilitates one-handed operation of the release buttons 9 while maintaining control of the carrying strap formed by the carrying straps fastened to the connecting body 7 and thus also the carrying system 1.

Figure 5A:
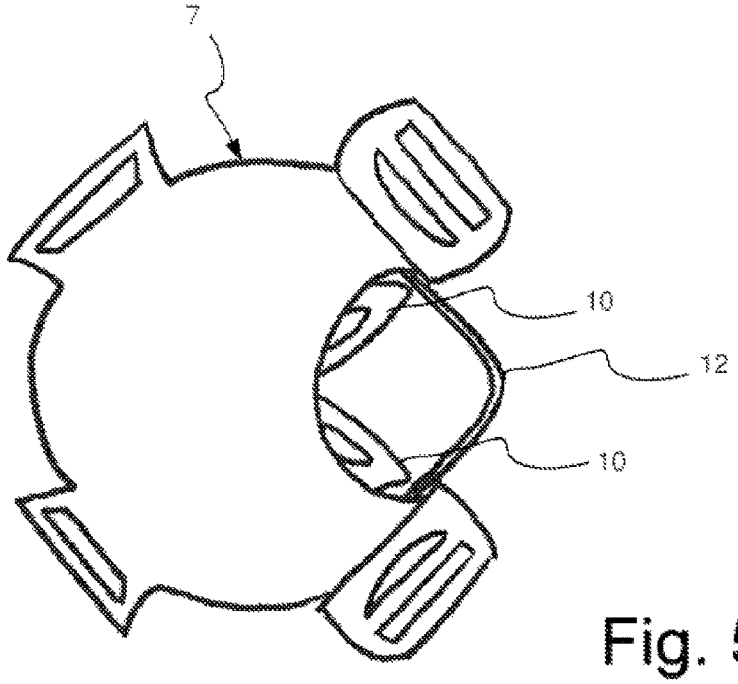
FIGS. 5*a* and 5*b* show a connecting body according to an alternative embodiment.
Figure 5B:
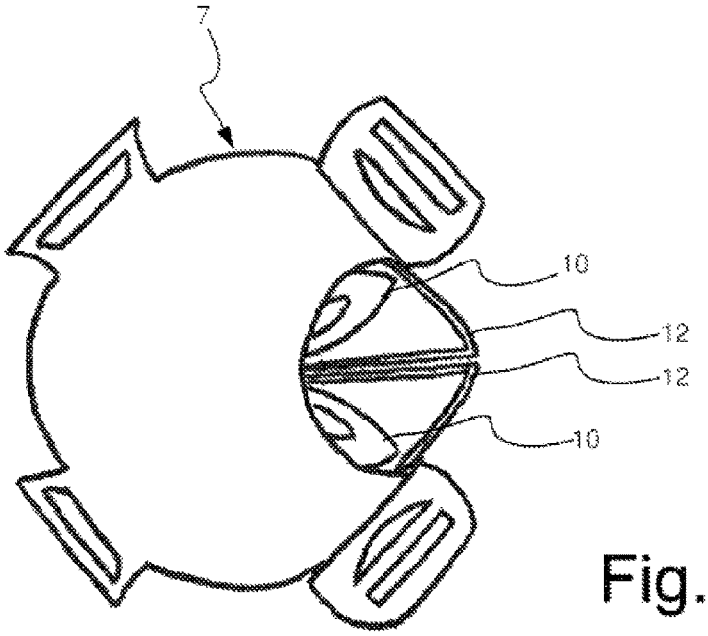

FIGS. 5*a* and 5*b* show two alternative embodiments of the connecting body 7 which comprises at least one locking guard 12. The locking guard 12 is arranged so that it protects the release portions 10 from accidentally being unlocked by e.g. the user. The locking guard 12 may have different size or shape depending on the application and the appearance of the carrying system 1.

Figure 6:
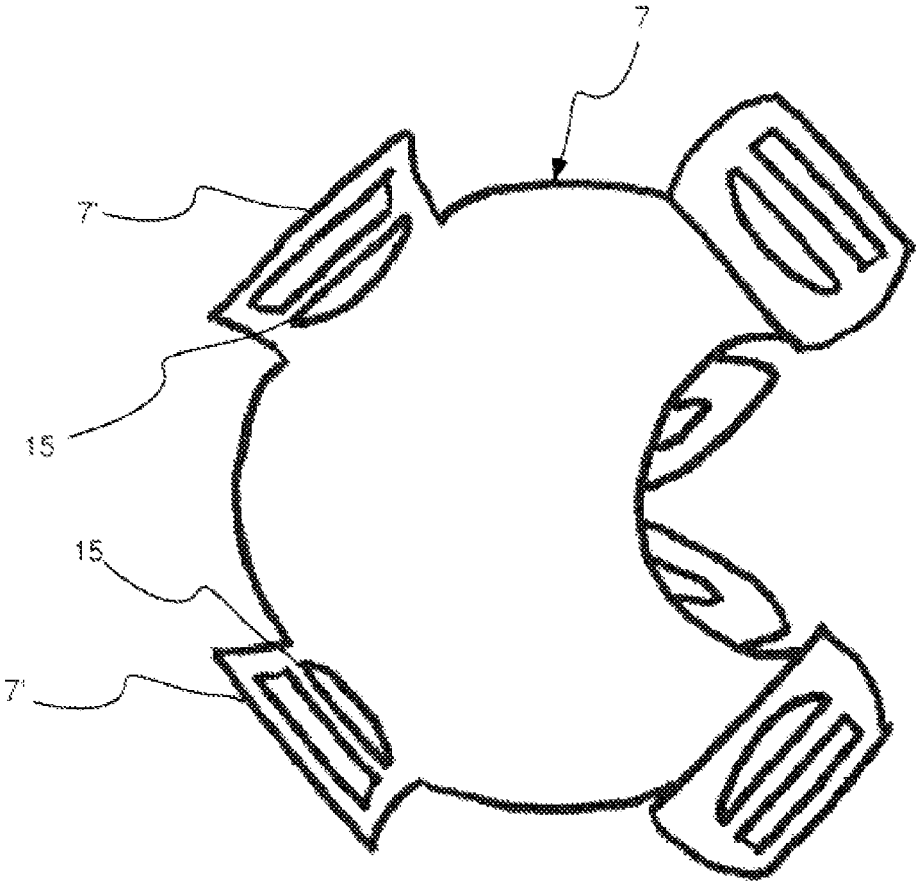
FIG. 6 shows a connecting body according to yet another embodiment.

FIG. 6 shows an alternative embodiment of the connection between the connecting body 7 and the second and fourth carrying strap 4, 6. The fastening part 7' has an additional opening 15 so that the carrying straps 4, 6 may be connected in an alternative manner. This embodiment makes it easier to replace the connecting body 7 if necessary.

Figure 7:
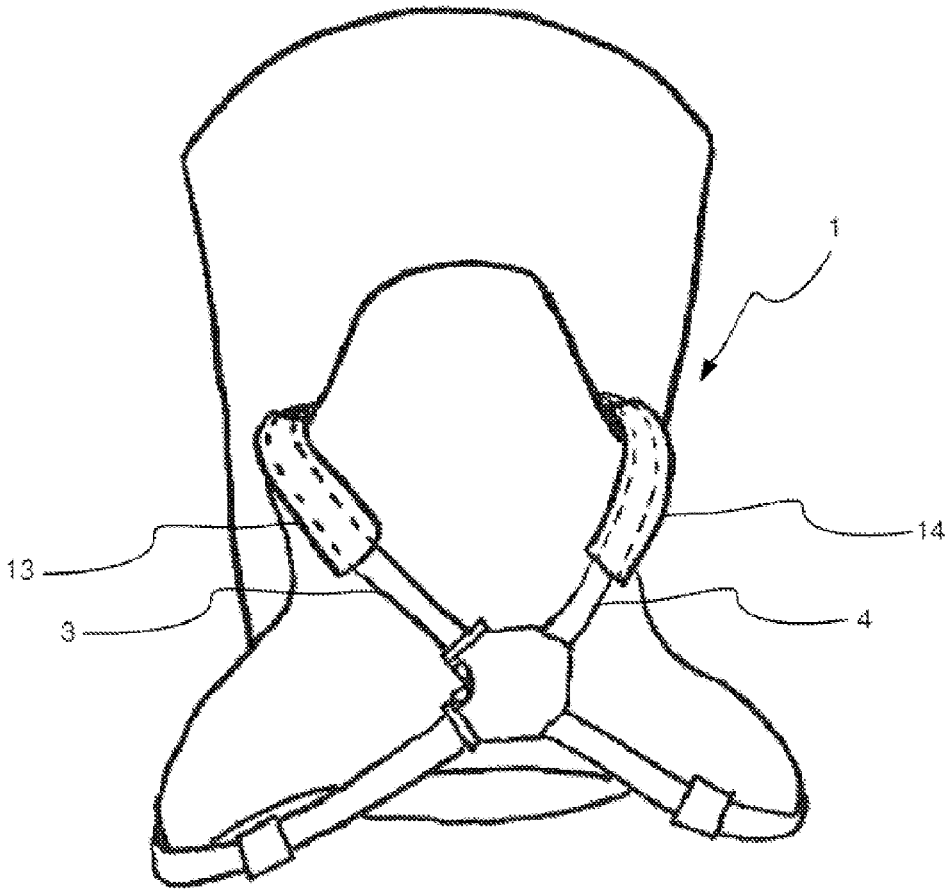
FIG. 7 shows a carrying system according to an alternative embodiment.

In another alternative embodiment, shown in FIG. 7, the upper carrying strap 3, 4 may include a first and second cover 13, 14 which are arranged around one carrying strap 3, 4 each providing a soft contact between the carrying straps 3, 4 and the shoulder/chest of the user. Each cover 13, 14 may include a formable and/or flexible inner portion (not shown) which may form the cover 13, 14 after the shape and size of the shoulder/chest of the user. The inner portion may also be configured to retain this form after the user takes the carrying system 1 off of his/her shoulders so that the covers 13, 14 have the same shape as the last time the carrying system 1 was carried. If another user should be using the carrying system 1, with a different shoulder and chest shape and size, the covers 13, 14 may be adjusted to fit the new user and retain that new form. The covers 13, 14 may include detachable covers 13, 14 which are washable for keeping them clean and fresh. During the use of such carrying systems 1 dirt and sweat may be absorbed by the part closest to the body of the user, in this case it may be the covers 13, 14. It may then be desirable to be able to clean them and keep them fresh so that they do not need to be exchanged. The material of the covers 13, 14 may be a washable material, such as cotton or polyester, which is able to retain its abilities, e.g. softness and flexibility, after they have been washed several times.

Figure 8:
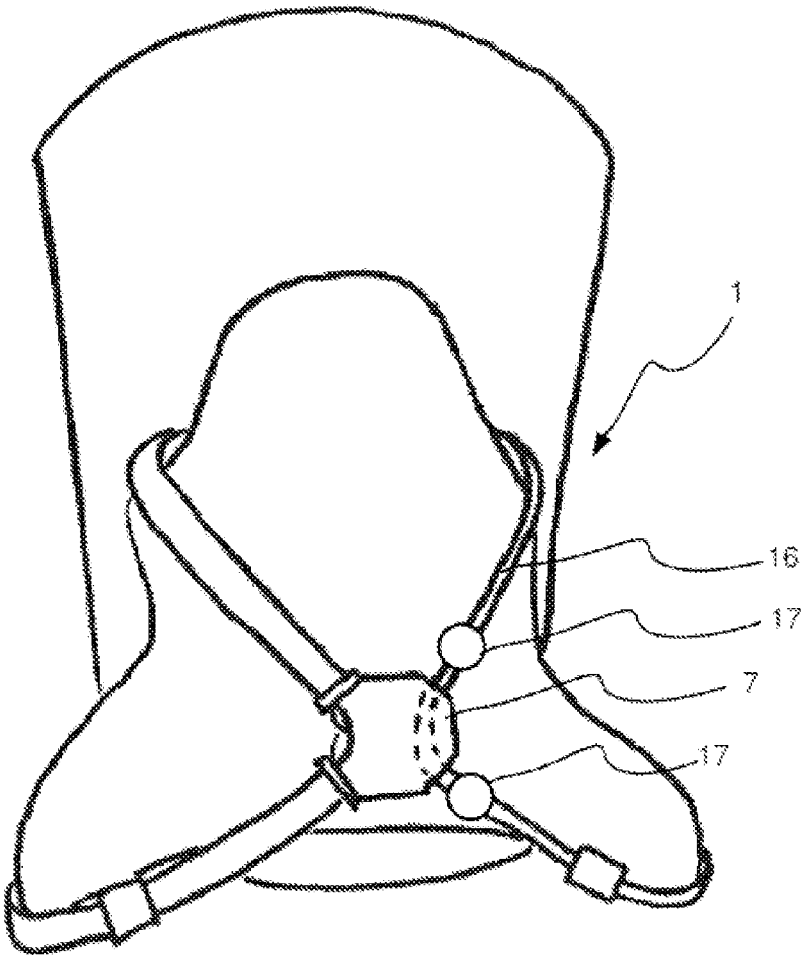
FIG. 8 shows a carrying system according to an alternative embodiment.

In another embodiment of the carrying system, which is shown in FIG. 8, the second and fourth carrying strap may be made in one piece, as one solitary strap 16, arranged to extend through the connecting body 7 or through e.g. a loop (not shown) on the back side of the connecting body 7. Further, the carrying system comprises stopping means 17 which are movably arranged on the strap 16 and configured to define a length of the strap 16 of which the connecting body 7 is allowed to slide. Depending on the desired location of the connecting body 7 the user may move stopping means 17 to a desired location on the strap 16.

In one embodiment the connecting body and the fastening bodies of the carrying system is utilized in an article of clothing providing an easy manner of unbuttoning the article of clothing.

A person skilled in the art would of course realize that the appearance of the connecting body 7 may be inverted so that it may be adapted for both a right-handed and a left-handed user or for the appearance of the associated equipment E.

The described embodiments of the carrying system may be used in all kind of applications, such as back packs, working clothes, tool belts, sport equipment or the like.

The teachings herein have mainly been described above with reference to a few embodiments. However, as is readily appreciated by a person skilled in the art, other embodiments than the ones disclosed above are equally possible within the scope of the disclosure, as defined by the appended patent claims.

The invention claimed is:

1. A carrying system, comprising:

a first carrying strap adapted to extend from a first position of an upper back section of said carrying system over a first shoulder of a user substantially diagonally downwards towards at least one of a stomach area and a solar plexus of said user;

a second carrying strap adapted to extend from a second position of said upper back section of said carrying system over a second shoulder of said user substantially diagonally downwards towards the at least one of the stomach area and the solar plexus of said user;

a third carrying strap adapted to extend from a first position of a lower back section of said carrying system under a first arm of said user substantially diagonally upwards towards the at least one of the stomach area and the solar plexus of said user;

a fourth carrying strap adapted to extend from a second position of said lower back section of said carrying system under a second arm of said user substantially diagonally upwards towards the at least one of the stomach area and the solar plexus of said user;

a connecting body configured to connect with respective ends of said carrying straps, wherein at least two of said respective ends are permanent, said connecting body includes first and second cavities connected to a central recess configured to guide a finger of a user to a side of first and second fastening bodies that are separately engageable with the connecting body; and said first and second fastening bodies connected to respective ends of the other two of said carrying straps, said first and second fastening bodies having respective protrusions and tabs, the respective tabs including inwardly facing first and second release portions configured to be positioned in the central recess adjacent to each other for unlocking by one hand of the user, and wherein said connecting body is adapted to connect said respective first and second fastening bodies.

2. The carrying system according to claim 1, wherein said first and second fastening bodies are adapted to be pressed into the connecting body and locked there, and wherein the first and second release portions of said connecting body comprise two adjacent to each other placed release buttons adapted to disengage the fastening bodies of the two carrying straps from the connecting body so that the carrying system may be disengaged from a carrying user.

3. The carrying system according to claim 1, wherein said first and second fastening bodies are adapted to be pressed into the connecting body and locked there, and wherein each fastening body is arranged with the first and second release portions adapted to disengage the fastening body from the connecting body so that the carrying system may be disengaged from a carrying user and wherein said release portions are arranged to be placed adjacent each other when locked in the connecting body to enable easy access to said release portions.

4. The carrying system according to claim 3, wherein said first and second release portions are arranged through respective cavities of and in the recess of said connecting body, and wherein said recess is arranged between said two respective fastening bodies when said fastening bodies are pressed into the connecting body to enable easy one-handed disengagement of the carrying system from said carrying user.

5. The carrying system according to claim 4, wherein said connecting body has a substantially round or circular periphery in a plane defined by said recess to enable easy one-handed disengagement of the carrying system from said carrying user by providing an ergonomic gripping position.

6. The carrying system according to claim 3, wherein said connecting body comprises at least one locking guard extending from the recess of the connecting body and for protecting first and second tabs of the respective first and second release portions from accidentally being unlocked.

7. The carrying system according to claim 1, wherein said first, second, third and fourth carrying straps together forms a cross when they are connected by means of said connecting body to enable an ergonomic carrying position for said carrying system.

8. The carrying system according to claim 1, wherein at least one of said third and fourth carrying straps is arranged with a tightening means for tightening the corresponding carrying strap.

9. The carrying system according to claim 1, further comprising at least one strap cover arranged around the first or second carrying strap.

10. The carrying system according to claim 9, wherein said strap cover of the first or second carry strap is detachable.

11. The carrying system according to claim 9, wherein the said strap cover is made of a washable material.

12. The carrying system according to claim 1, wherein the second and fourth carrying strap is one solitary strap.

13. The carrying system according to claim 1, further comprising an ergonomic back plate which is substantially covering the entire back of a user and wherein said first and second upper back section of said carrying system are adapted on an upper section of said back plate and said first and second lower back section of said carrying system are adapted on an lower section of said back plate.

14. The carrying system according to claim 1, wherein said carrying straps are made of a material selected from a group consisting of woven fabric of synthetic fibre, moulded plastic, bulletproof material or textile.

15. The carrying system according to claim 1, wherein said fastening body and said connecting body are connected to respective carrying strap by gluing, welding, riveting, sewing, locking, a hook-and loop fastening strip or by threading said carrying strap through a fastening part.

16. The carrying system according to claim 1, wherein said carrying straps are configured to form a backpack.

17. The carrying system according to claim 1, wherein said carrying straps are configured to form an article of clothing or sports.

18. The carrying system according to claim 1, wherein said carrying straps are configured to form protective equipment to protect at least one of police and personnel.

19. A system comprising: a first carrying strap adapted to extend from a first position of an upper back section of said carrying system over a first shoulder of a user substantially diagonally downwards towards at least one of a stomach area and a solar plexus of said user; a second carrying strap adapted to extend from a second position of said upper back section of said carrying system over a second shoulder of said user substantially diagonally downwards towards the at least one of the stomach area and the solar plexus of said user; a third carrying strap adapted to extend from a first position of a lower back section of said carrying system under a first arm of said user substantially diagonally upwards towards the at least one of the stomach area and the solar plexus of said user; a fourth carrying strap adapted to extend from a second position of said lower back section of said carrying system under a second arm of said user substantially diagonally upwards towards the at least one of the stomach area and the solar plexus of said user; and a connecting body being adapted to be fixed at respective ends of at least two of the carrying straps, at least two of said respective ends being permanent, said connecting body being adapted to connect respective first and second fastening bodies of at least two of the carrying straps, and the first and second fastening bodies being separately engageable with the connecting body, wherein said connecting body includes first and second cavities connected to a central recess configured to guide a finger of a user to a side of first and second fastening bodies that are separately engageable with the connecting body, and wherein said first and second fastening bodies having respective protrusions and tabs, the respective tabs including inwardly facing first and second release portions configured to be positioned in the central recess adjacent to each other for unlocking by one hand of the user.

20. A system comprising: a first carrying strap adapted to extend from a first position of an upper back section of said carrying system over a first shoulder of a user substantially diagonally downwards towards at least one of a stomach area and a solar plexus of said user; a second carrying strap adapted to extend from a second position of said upper back section of said carrying system over a second shoulder of said user substantially diagonally downwards towards the at least one of the stomach area and the solar plexus of said user; a third carrying strap adapted to extend from a first position of a lower back section of said carrying system under a first arm of said user substantially diagonally upwards towards the at least one of the stomach area and the solar plexus of said user; a fourth carrying strap adapted to extend from a second position of said lower back section of said carrying system under a second arm of said user substantially diagonally upwards towards the at least one of the stomach area and the solar plexus of said user; and a connecting body configured to fixedly connect with at least two of the carrying straps and releasably connect with respective first and second fastening bodies of the other of the carrying straps, at least two respective ends of said at least two of the carrying straps being permanent, and the first and second fastening bodies being separately engageable with the connecting body, wherein said connecting body includes first and second cavities connected to a central recess configured to guide a finger of a user to a side of first and second fastening bodies that are separately engageable with the connecting body, and wherein said first and second fastening bodies having respective protrusions and tabs, the respective tabs including inwardly facing first and second release portions configured to be positioned in the central recess adjacent to each other for unlocking by one hand of the user.

* * * * *